US010869536B2

(12) United States Patent
Jeong et al.

(10) Patent No.: US 10,869,536 B2
(45) Date of Patent: Dec. 22, 2020

(54) SQUEEZE-TYPE MASCARA CONTAINER

(71) Applicant: AMOREPACIFIC CORPORATION, Seoul (KR)

(72) Inventors: Hae Won Jeong, Yongin-si (KR); Ji Young Lee, Yongin-si (KR); Young Hea Roh, Yongin-si (KR); Min Kyung Sim, Yongin-si (KR); Yeong Jin Choi, Yongin-si (KR)

(73) Assignee: AMOREPACIFIC CORPORATION, Seoul (KR)

( * ) Notice: Subject to any disclaimer, the term of this patent is extended or adjusted under 35 U.S.C. 154(b) by 911 days.

(21) Appl. No.: 14/650,144

(22) PCT Filed: Dec. 6, 2013

(86) PCT No.: PCT/KR2013/011292
§ 371 (c)(1),
(2) Date: Jun. 5, 2015

(87) PCT Pub. No.: WO2014/088368
PCT Pub. Date: Jun. 12, 2014

(65) Prior Publication Data

US 2015/0366324 A1 Dec. 24, 2015

(30) Foreign Application Priority Data

Dec. 7, 2012 (KR) ..... 10-2012-0142139

(51) Int. Cl.
*A45D 34/04* (2006.01)
*A45D 40/26* (2006.01)

(52) U.S. Cl.
CPC ..... *A45D 40/267* (2013.01); *A45D 34/045* (2013.01); *A45D 40/265* (2013.01)

(58) Field of Classification Search
CPC ... A45D 40/265; A45D 40/267; A45D 34/045
See application file for complete search history.

(56) References Cited

U.S. PATENT DOCUMENTS 4,780,017 A * 10/1988 Bradford ..... A45D 34/045 401/123
5,332,121 A * 7/1994 Schmidt ..... B29C 45/1646 222/105

(Continued)

FOREIGN PATENT DOCUMENTS

JP 09103322 4/1997
JP 2000253926 9/2000

(Continued)

OTHER PUBLICATIONS

International Search Report—PCT/KR2013/011292 dated Mar. 24, 2014.

(Continued)

*Primary Examiner* — Steven A. Reynolds
*Assistant Examiner* — Javier A Pagan
(74) *Attorney, Agent, or Firm* — Cantor Colburn LLP

(57) ABSTRACT

The present invention provides a mascara container including: a pouch-shaped inner container of a film material; and an outer container of an elastic material that covers the outside of the inner container. According to the present invention, highly-viscous mascara content can easily be transferred to an application member when a user lightly squeezes a container, so that the residual mascara content inside the container can easily be discharged to increase the usable amount of content after the mascara is opened, regardless of the duration of use. Accordingly, the effect can be realized of improving eyelash volume by applying a sufficient amount of mascara content.

5 Claims, 6 Drawing Sheets

(56) References Cited

U.S. PATENT DOCUMENTS

| | | | | |
|---|---|---|---|---|
| 6,158,912 | A * | 12/2000 | Miraglia | A45D 40/265<br>401/121 |
| 6,572,296 | B2 * | 6/2003 | Schrepf | A45D 34/045<br>132/218 |
| 2003/0015211 | A1 * | 1/2003 | Bouix | A45D 40/265<br>132/218 |
| 2003/0172950 | A1 * | 9/2003 | Bouix | A45D 34/045<br>132/318 |
| 2006/0045605 | A1 * | 3/2006 | Deans | A45D 34/045<br>401/126 |
| 2006/0102192 | A1 * | 5/2006 | Fischer | A45D 33/18<br>132/317 |
| 2009/0071498 | A1 * | 3/2009 | Tranchant | A45D 40/265<br>132/218 |
| 2011/0243639 | A1 * | 10/2011 | Francavilla | A45D 34/045<br>401/122 |

FOREIGN PATENT DOCUMENTS

| | | |
|---|---|---|
| JP | 2001211930 | 8/2001 |
| KR | 1020070087569 | 8/2007 |
| NL | 287202 | 2/1965 |
| WO | 0071439 | 11/2000 |

OTHER PUBLICATIONS

Written Opinion—PCT/KR2013/011292 dated Mar. 24, 2014.
Extended European Search Report—European Application No. 13860304.8 dated Jun. 22, 2016.

* cited by examiner

Comparative Example 1

Usable amount
16.07%

Comparative Example 2

Usable amount
29.00%

Comparative Example 3

Usable amount
52.62%

Comparative Example 4

Usable amount
34.62%

Comparative Example 5

Usable amount
62.08%

SQUEEZE-TYPE MASCARA CONTAINER

TECHNICAL FIELD

The present disclosure relates to a squeeze-type mascara container, more particularly to a squeeze-type mascara container which effectively delivers a mascara content to an applicator when pressure is applied to an outer container having elasticity and, thereby, maintains the usable amount of the mascara content and the application amount on eyelashes throughout the duration of mascara use.

BACKGROUND ART

In general, a mascara container is a hollow container prepared from blow molding of a general-purpose resin such as PP, PE and PET. It usually has a thickness of 0.5 mm or greater and is hardly deformed even when squeezed with a force of 5 kgf or greater.

Generally, mascara has a viscosity of 100,000-200,000 cps and is hardly fluidic. In general, the mascara is used as follows. A brush is inserted and then taken out at the inlet of the hollow container by a pumping action perpendicularly with respect to a wiper which serves to adequately control the amount of the content to be applied to the brush. As the brush enters the container, the content inside the container is pushed toward the wall of the container and remains there without flowing no more. As a result, only the content located at the center portion of the container is used, resulting in a cavitation (void formation) phenomenon of only the center portion becoming vacant as the content in the container is used for a long time. For this reason, the amount of the content applied to the brush is decreased. Due to the decreased application amount of the content, a mascara user considers that the mascara has been dried and often makes complaints. Since the amount of the content adhering to the wall is usually as much as about 50% of the filling capacity of the content, it is unfavorable not only environmentally but also in terms of resource efficiency.

The amount of mascara attached to eyelashes is increased as the proportion of a viscous solid content such as a wax or a polymer is higher, which is favored by customers who want to have voluminous eyelashes. However, as described above, the cavitation phenomenon is intensified as the viscosity of the content is higher. As a result, the usable amount of the content decreases and the user considers that the product has been dried.

A method of using an elastic material to achieve a soft wall of a mascara container is disclosed in Korean Patent Publication No. 10-2007-0087569. However, it is merely a hollow container wherein the lower part of the wall is flexible and able to be expanded to contain mascara, not a squeezable container including a pouch-shaped inner container for containing a content and an outer rubber (silicone) container. Therefore, it has the problem that the usable amount of the content is decreased. Also, in terms of sealing and protection of the content, there are problems in that the content is easily dried and low-molecular-weight materials such as a wax seeps out of the container because a sealed pouch structure is not employed. In addition, the container in which a tube is coupled with a wiper is problematic in that, due to the interference by a shoulder and the large diameter of the container, it is difficult to maximize the usable amount of the content, the squeezing property is unsatisfactory and the brush may be easily deformed and damaged by external impact.

Therefore, there has been need for a mascara product which is favorable in terms of environment friendliness and resource efficiency by allowing use of a larger amount of the content.

DISCLOSURE

Technical Problem

The present disclosure is directed to providing a dual-structure, squeeze-type mascara container wherein an outer container formed of an elastic material is used to increase physical contact between a mascara content contained inside the mascara container and an applicator, in order to maximize the usable amount of the mascara content without the cavitation phenomenon caused by drying of the mascara content with time.

Technical Solution

In an aspect, the present disclosure provides a mascara container including: a pouch-shaped inner container formed of a film material; and an outer container formed of an elastic material which surrounds the inner container.

In an exemplary embodiment of the present disclosure, the elastic material may be deformed by 1-10 mm when a force of 0.2-0.5 kgf is applied.

In an exemplary embodiment of the present disclosure, the elastic material may be one or more selected from a group consisting of silicone, fluorosilicone, butyl rubber, nitrile rubber, ethylene propylene rubber, urethane rubber and a thermoplastic elastomer (TPE).

In an exemplary embodiment of the present disclosure, the film may be a blocking film having blocking property for protecting a mascara content.

In an exemplary embodiment of the present disclosure, the film may be deformed by 1-10 mm when a force of 0.01-0.5 kgf is applied.

In an exemplary embodiment of the present disclosure, the film may be a laminated film or a multi-layer film formed of one or more selected from a group consisting of aluminum, nylon, urethane, a thermoplastic elastomer (TPE), an olefin resin, polyamide (PA), polyethylene terephthalate (PET), polyethylene naphthalate (PEN), polypropylene (PP), polyethylene (PE), a cyclic olefin copolymer (COC), ethylene-vinyl acetate (EVA) and ethylene-vinyl alcohol (EVAL).

In an exemplary embodiment of the present disclosure, the inner container may include a shoulder which is attached to an opening and a wiper which is attachable to and detachable from the shoulder.

In an exemplary embodiment of the present disclosure, the shoulder may be formed of one or more selected from a group consisting of polypropylene (PP), polyethylene (PE), acrylonitrile butadiene styrene (ABS), acrylonitrile styrene (AS), polyethylene terephthalate (PET), polyethylene terephthalate glycol (PETG), polycyclohexylene dimethylene terephthalate acid (PCTA) and nylon.

In an exemplary embodiment of the present disclosure, the mascara content may have a viscosity of 200,000-300,000 cps.

Advantageous Effects

According to the present disclosure, since a highly viscous mascara content can be easily delivered to an applicator when a user lightly squeezes an outer container of a squeeze-type mascara container, the residual mascara content inside the container can be easily discharged and, thus, the usable amount of the content can be increased after the mascara is opened, through the duration of use. Accordingly, the effect of enhancing eyelash volume can be achieved by applying a sufficient amount of the mascara content. In addition, a blocking film pouch of the inner container of the squeeze-type mascara container according to the present disclosure may prevent drying of the mascara content and maintain its quality by preventing volatilization of the mascara content and compatibility with the container.

BEST MODE

Figure 1:
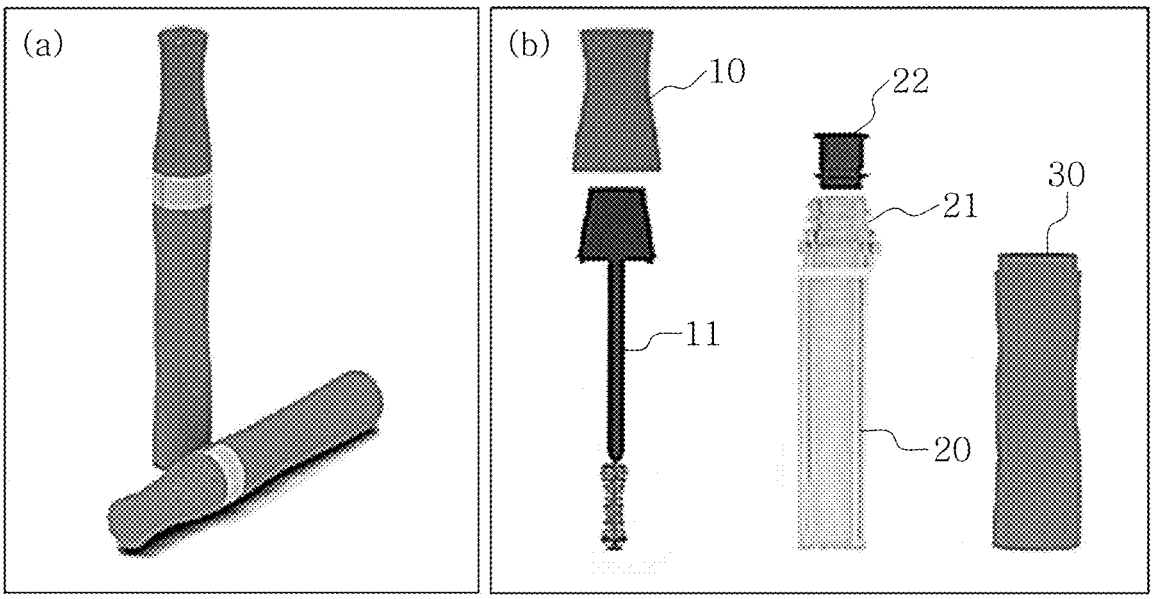
FIG. 1 is a photograph of a squeeze-type mascara container according to an exemplary embodiment of the present disclosure.

Hereinafter, specific embodiments of the present disclosure will be described in detail so that those of ordinary skill in the art to which the present disclosure belongs can easily carry out the present disclosure.

The present disclosure provides a dual-structure mascara container for containing a mascara content inside thereof, which includes: a pouch-shaped inner container 20 formed of a blocking film material having blocking property for protecting the mascara content; and an outer container 30 formed of an elastic material which surrounds the inner container.

First, the mascara container of the present disclosure includes an outer container formed of an elastic material which surrounds an inner container.

The stretching and contraction, and deformation of the elastic material has a very good effect on easy mixing of the content with a brush. In addition, since the outer container has superior friction, the inner and outer containers are not separated due to squeezing. And, due to excellent retractility, the container easily returns to the original shape after squeezing. In addition, external coating is unnecessary due to very superior scratch resistance and other physical properties. Accordingly, post-processing cost can be saved.

In the present disclosure, the elastic material is not particularly limited as long as it has elasticity and flexibility. It may be a material that is deformed by 1 mm or greater, specifically 5 mm or greater, when a force of 0.5 kgf or weaker is applied. The deformation may be normal deformation or flexural deformation. Particularly, it may be deformed by 1-10 mm when a force of 0.2-0.5 kgf, specifically 0.2-0.3 kgf, is applied. If the force is weaker than 0.2 kgf, squeezing may not occur. And, if it is greater than 0.5 kgf, a user cannot squeeze the container with one hand. If the deformation is smaller than 1 mm, the effect of content mixing is not enough.

In the present disclosure, the elastic material may be one or more selected from a group consisting of silicone, fluorosilicone, butyl rubber, nitrile rubber, ethylene propylene rubber, urethane rubber and a thermoplastic elastomer (TPE). Specifically, it may be silicone, although not being particularly limited thereto. Silicone is superior in toxicity and hygiene enough to be used for baby bottle nipples and is very excellent in grip feel.

A mascara user will consider the content has been dried when the application amount is decreased. But, this may be because the content adheres to a wall of the container and is not delivered to the brush. Since the outer container of the mascara container of the present disclosure is formed of an elastic material, it offers excellent grip feel and, when the user slightly squeezes the mascara container with hand, the mascara content inside the container can be easily delivered to an applicator without the void formation phenomenon.

Meanwhile, since an easily squeezable elastic rubber material (particularly silicone) does not have good compatibility with the content, low-molecular-weight waxes and oils included in the content seep out through adsorption-desorption. As the volatile components of the content are discharged out of the container, the content is decreased and begins to be dried. In addition, the odor of the waxes and oils on the container wall is another problem. Accordingly, to enable squeezing and solve the above-described problems, a container in which a blocking film pouch is provided in therein is provided in the present disclosure.

For this, the mascara container of the present disclosure includes a pouch-shaped inner container formed of a blocking film material having blocking property for protecting the mascara content.

In the present disclosure, the term blocking property refers to a property of sealing and protecting the mascara content by blocking the mascara content from seeping out. The pouch-shaped inner container of the present disclosure has a structure favorable for the sealing and protection of the content.

In the present disclosure, the blocking film is one having blocking property for protecting the mascara content and is not particularly limited as long as it prevents the discharge and drying of the content. But, the blocking film pouch should have blocking property and flexibility at the same time.

Accordingly, in the present disclosure, the blocking film may be a flexible material which is deformed by 1-10 mm when a force of 0.01-0.5 kgf, specifically 0.01-0.3 kgf, is applied. As the inner container is formed of the material having flexibility and elasticity, the inner container is deformed when a force is applied to the outer container.

In the present disclosure, the blocking film may be a laminated film or a multi-layer film formed of one or more selected from a group consisting of aluminum, nylon, urethane, a thermoplastic elastomer (TPE), an olefin resin, polyamide (PA), polyethylene terephthalate (PET), polyethylene naphthalate (PEN), polypropylene (PP), polyethylene (PE), a cyclic olefin copolymer (COC), ethylene-vinyl acetate (EVA) and ethylene-vinyl alcohol (EVAL).

Specifically, the blocking film may have a thickness of 400 μm or smaller. If the thickness is greater than 400 μm, the squeezing property may be unsatisfactory.

In the present disclosure, the inner container may include a shoulder 21 which is attached to a pouch-shaped opening and a wiper 22 which is attachable to and detachable from the shoulder.

The wiper serves to screen the content delivered to the applicator and the shoulder serves to fix the wiper to the opening of the container.

In the present disclosure, the shoulder is bonded to the opening of the container to achieve complete sealing. The bonding may be accomplished by thermal bonding, ultrasonic bonding, high-frequency bonding, bonding using an adhesive harmless to human, or the like. Specifically, thermal bonding may be employed. More specifically, thermal bonding may be performed by contacting the blocking film with the bottom portion of the shoulder using a jig and then applying heat.

Specifically, the opening to which the shoulder is bonded may have an oval shape, although not being particularly limited thereto. High-quality bonding can be accomplished in a bonding process when the opening has an oval shape.

In the present disclosure, the shoulder may be formed of one or more selected from a group consisting of polypropylene (PP), polyethylene (PE), acrylonitrile butadiene styrene (ABS), acrylonitrile styrene (AS), polyethylene terephthalate (PET), polyethylene terephthalate glycol (PETG), polycyclohexylene dimethylene terephthalate acid (PCTA) and nylon. Specifically, it may be formed of polypropylene (PP) or polyethylene (PE) which can be easily bonded with the wiper. Since PE or PP can be thermally bonded easily, it ensures good sealing and productivity. In addition, it provides good sealing after capping due to high ductility.

Specifically, the part where the inner container contacts the shoulder may be covered and surrounded by the outer container to provide improved sealing and appearance.

Figure 2:
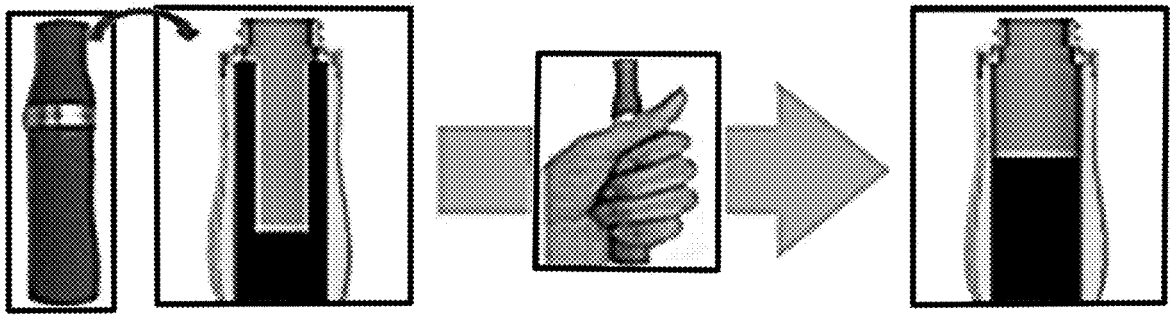
FIG. 2 schematically illustrates the principle by which the void formation phenomenon is resolved when a squeeze-type mascara container according to an exemplary embodiment of the present disclosure is used.

The mascara container of the present disclosure has a dual structure in which the inner container is surrounded by the outer container. Accordingly, the sealing and protection of the content by the inner container and the squeezing property of the container can be achieved at the same time. Since the mascara container of the present disclosure has squeezing property, the user can easily deliver the mascara content to the applicator, e.g., the brush, by squeezing the container with a hand and a predetermined amount of the content can be applied on eyelashes throughout the duration of mascara use after opening without the cavitation (void formation) phenomenon of the content. FIG. 2 schematically illustrates the principle by which the void formation phenomenon is resolved when the squeeze-type mascara container according to an exemplary embodiment of the present disclosure is used.

According to the present disclosure, 60 vol % or more, specifically 80 vol % or more, of the mascara content contained in the mascara container may be used.

In the present disclosure, the mascara content may have a high viscosity of 200,000-300,000 cps, although not being particularly limited thereto. As the viscosity of the mascara content increases, the effect of enhancing eyelash volume is improved. However, the existing mascara container has the problem of fast drying and cavitation phenomenon of the content. The mascara container of the present disclosure dissolves this problem by employing the dual structure as described above and can be used for highly viscous mascara for enhancing eyelash volume.

Hereinafter, the present disclosure will be described in detail through examples. However, the following examples are for illustrative purposes and the scope of the present disclosure is not limited by the examples.

EXAMPLE 1

A squeeze-type mascara container was prepared by using an outer container formed of a silicone resin and an inner container formed of a PET/PE film, and a mascara content was contained therein.

Test Example 1

Change in Application Amount of Content Depending on Duration of Mascara Use While using squeeze-type mascara using the squeeze-type mascara container of Example 1 for 3 months, the amount of the mascara content applied onto eyelashes was measured. The result is shown in FIG. 4. The same experiment was carried out using an existing mascara container and the result is shown in FIG. 3.

Figure 3:
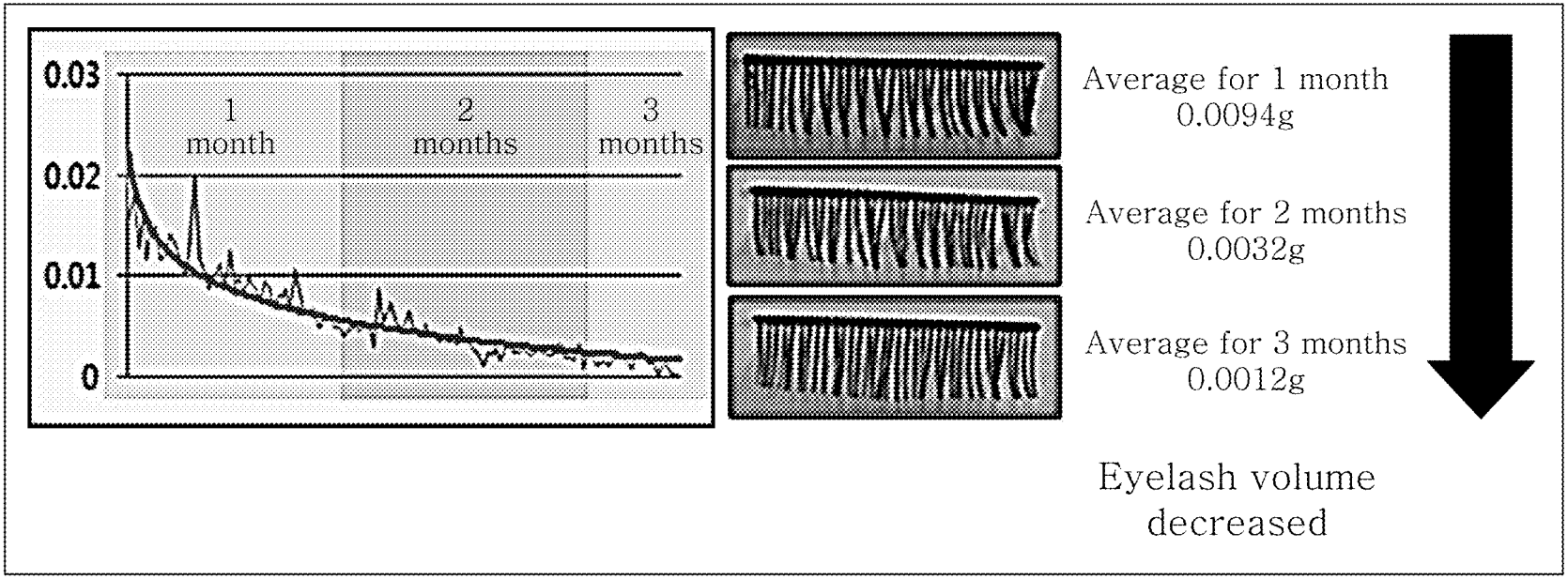
FIGS. 3 and 4 show the application amount of a content of an existing mascara container and a squeeze-type mascara container according to an exemplary embodiment of the present disclosure, respectively.
Figure 4:
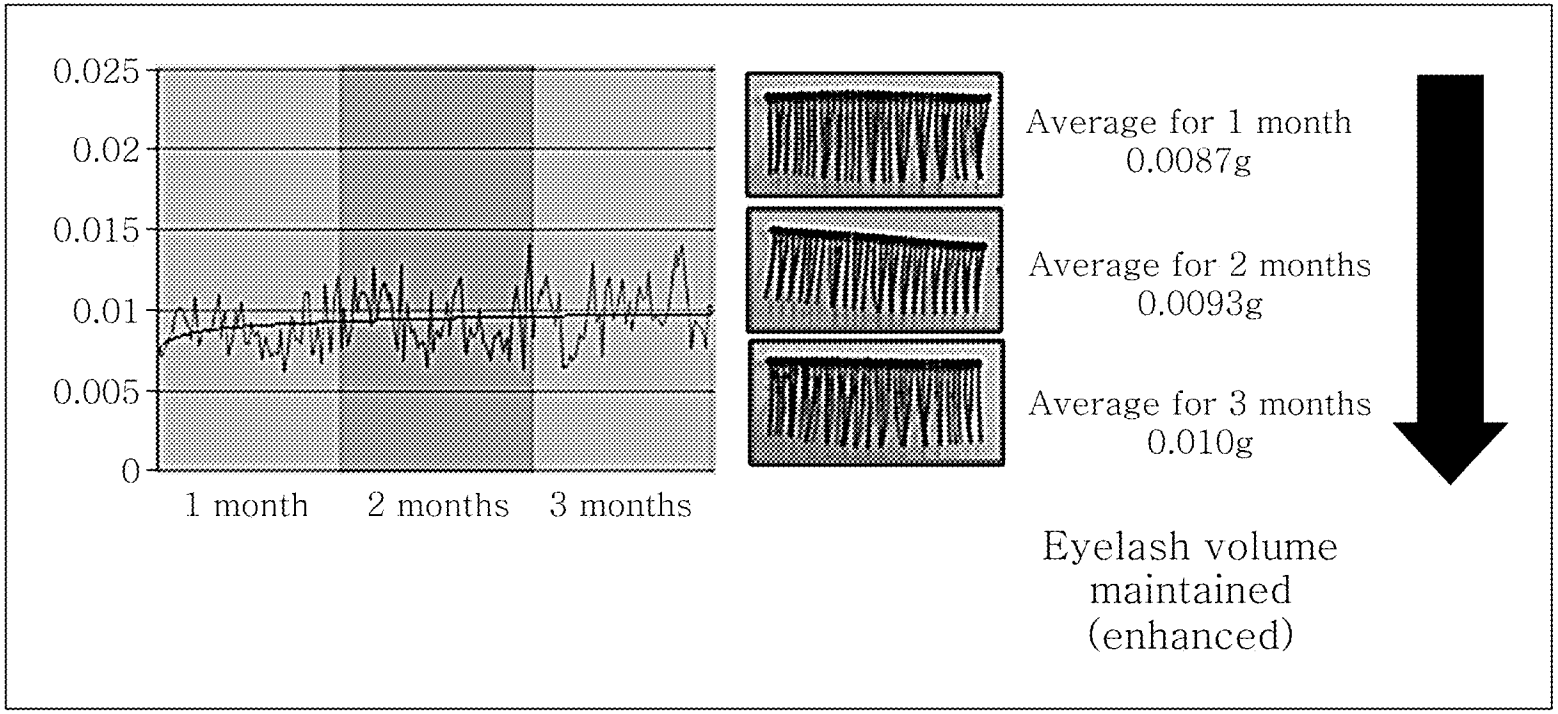

In FIG. 3, the mascara application amount decreased to ½ or less of the initial amount from 1 month. It was also found out that the application amount decreased appreciably in a test using artificial eyelashes. In contrast, as can be seen from FIG. 4, the application amount hardly changed after 2 or 3 months when the mascara container according to the present disclosure was used. It was also confirmed from a test using artificial eyelashes.

Test Example 2

Change in Application Amount Depending on Content Viscosity

Figure 5:
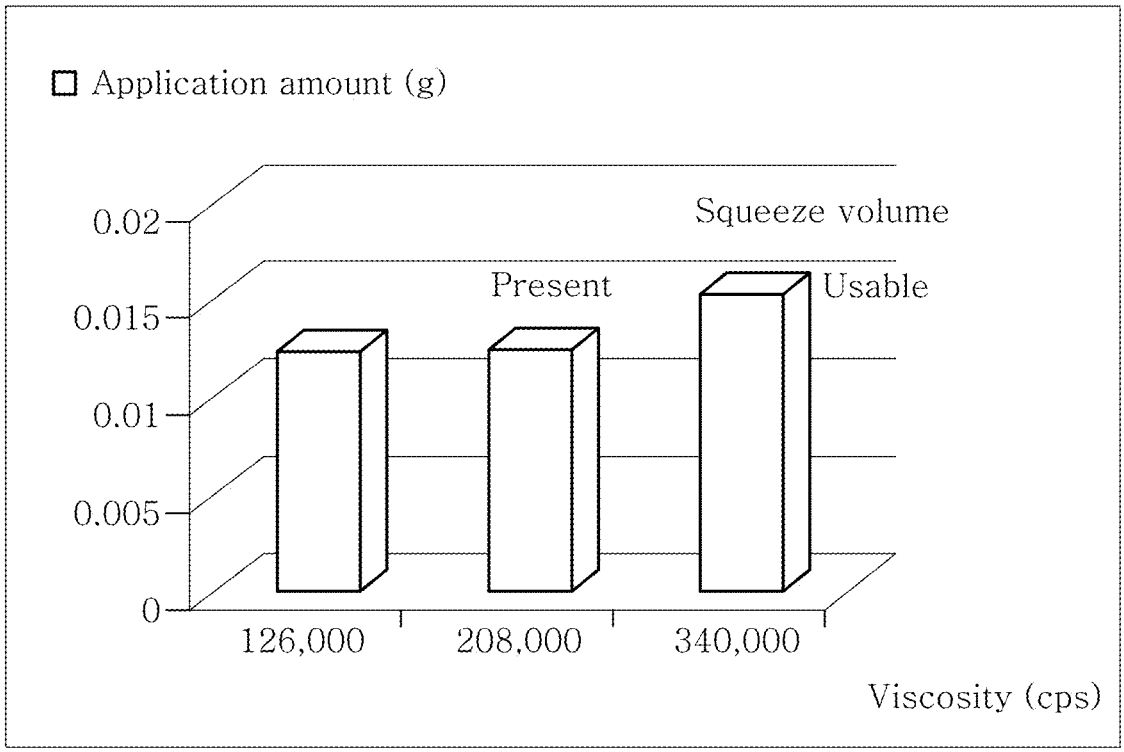
FIG. 5 shows the application amount of a mascara content depending on viscosity.

Contents with viscosities of 126,000 cps, 208,000 cps and 340,000 cps were applied onto eyelashes using the squeeze-type mascara container of Example 1. The result is shown in FIG. 5.

It was found out that the application amount was increased by about 30% or greater when the content had a viscosity of 340,000 cps as compared to the commonly used mascara content having a viscosity of 100,000-200,000 cps. As such, the mascara container of the present disclosure enables use of the highly viscous content that can provide enhanced eyelash volume. That is to say, the squeeze-type mascara container according to the present disclosure has a structure enabling use of the highly viscous content.

Test Example 3

Measurement of Usable Amount of Content

Figure 6:
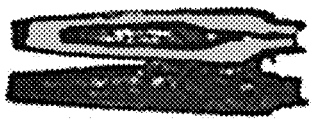
FIG. 6 shows the void formation phenomenon occurring when an existing mascara container is used as well as the usable amount of a content.
Figure 6:
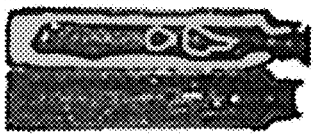
Figure 6:
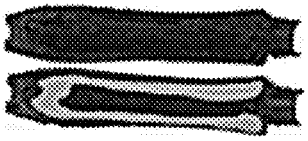
Figure 6:
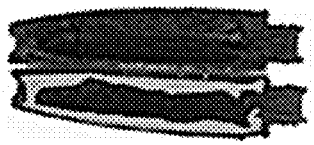
Figure 6:
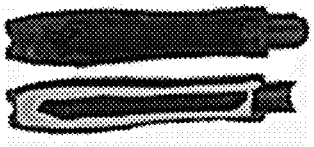

The squeeze-type mascara container of Example 1 and five existing mascara containers of Comparative Examples 1-5 were used until no more mascara was delivered to the brush. Then, the ratio of the usable amount of the content to the filling capacity was calculated. The result is shown in Table 1 and FIG. 6.

TABLE 1

| | Usable amount of content (vol %) | Filling capacity (g) |
|---|---|---|
| Comparative Example 1 | 16.07% | 8 g |
| Comparative Example 2 | 29.00% | 8 g |
| Comparative Example 3 | 52.62% | 6.5 g |
| Comparative Example 4 | 34.62% | 6.5 g |
| Comparative Example 5 | 62.08% | 6.5 g |
| Example 1 | 82% | 6.5 g |

When the existing mascara containers were used, the highly viscous content adhered to the wall of the containers and only small portions of the filling capacity could be used. This is due to the cavitation phenomenon described above, which occurs as the content adhering to the wall does not flow and only the content located at the center portion of the container is used as the mascara brush wand moves up and down along the central axis of the hollow container.

In contrast, 80% or more of the content could be used when the squeeze-type mascara container of Example 1 was used. That is to say, the squeeze-type mascara container of the present disclosure enables development of a mascara product which provides an effect of enhancing eyelash volume.

DETAILED DESCRIPTION OF MAIN ELEMENTS

10: outer cap
11: brush wand
20: inner container
21: shoulder
22: wiper

The invention claimed is:

1. Mascara comprising:

a mascara container comprising:

a pouch-shaped inner container formed of a film; and an outer container formed of an elastic material which surrounds the inner container, wherein the mascara container is a dual-structure, squeeze-type mascara container; and a mascara content contained in the mascara container, the mascara content having a viscosity of 200,000-300,000 cps, wherein the elastic material is one or more selected from a group consisting of silicone, fluorosilicone, butyl rubber, nitrile rubber, ethylene propylene rubber, urethane rubber and a thermoplastic elastomer (TPE), wherein the film is a laminated film or a multi-layer film formed of one or more selected from a group consisting of aluminum, nylon, urethane, a thermoplastic elastomer (TPE), an olefin resin, polyamide (PA), polyethylene terephthalate (PET), polyethylene naphthalate (PEN), polypropylene (PP), polyethylene (PE), a cyclic olefin copolymer (COC), ethylene-vinyl acetate (EVA) and ethylene-vinyl alcohol (EVAL), wherein the film is deformed by 1-10 mm when a force of 0.01-0.5 kgf is applied, and wherein when the mascara container is squeezed, a portion of the outer container is deformed to directly contact with a portion of the inner container, so that the portion of the inner container is deformed.

2. The mascara according to claim 1, wherein the elastic material is deformed by 1-10 mm when a force of 0.2-0.5 kgf is applied.

3. The mascara according to claim 1, wherein the film is a blocking film having blocking property for protecting a mascara content.

4. The mascara according to claim 1, wherein the inner container comprises a shoulder which is attached to an opening and a wiper which is attachable to and detachable from the shoulder.

5. The mascara according to claim 4, wherein the shoulder is formed of one or more selected from a group consisting of polypropylene (PP), polyethylene (PE), acrylonitrile butadiene styrene (ABS), acrylonitrile styrene (AS), polyethylene terephthalate (PET), polyethylene terephthalate glycol (PETG), polycyclohexylene dimethylene terephthalate acid (PCTA) and nylon.

* * * * *